United States Patent [19]

Hube

[11] Patent Number: 4,534,565

[45] Date of Patent: Aug. 13, 1985

[54] MULTI-LEVEL BOARD GAME

[76] Inventor: Lawrence D. Hube, 7722 Edgewood Rd., Pasadena, Md. 21122

[21] Appl. No.: 625,675

[22] Filed: Jun. 28, 1984

[51] Int. Cl.[3] ..... A63F 3/02

[52] U.S. Cl. ..... 273/241; 273/261; 273/285; 273/255

[58] Field of Search ..... 273/260, 261, 241, 285, 273/287, 255; 206/315.1; D21/23

[56] References Cited

U.S. PATENT DOCUMENTS

| | | | |
|---|---|---|---|
| D. 200,109 | 1/1965 | Hirsch | D21/23 |
| D. 226,669 | 4/1973 | Culver et al. | D21/23 |
| D. 263,245 | 3/1982 | Bonser | D21/23 |
| 1,418,409 | 6/1922 | Wakefield | 273/241 |
| 1,877,154 | 9/1932 | Weaver | 273/241 |
| 3,917,273 | 11/1975 | Blakewood, III | 273/261 |
| 4,133,537 | 1/1979 | Chappell | 273/241 |
| 4,194,741 | 3/1980 | Rea | 273/243 |
| 4,438,027 | 9/1982 | Kelly | 273/241 |

FOREIGN PATENT DOCUMENTS

| | | | |
|---|---|---|---|
| 601302 | 5/1948 | United Kingdom | 273/241 |

*Primary Examiner*—Richard C. Pinkham
*Assistant Examiner*—Scott L. Brown
*Attorney, Agent, or Firm*—John F. McClellan, Sr.

[57] ABSTRACT

Improved board game with plurality of rectangular planar elements, each marked with a rectangular array of playing squares includes a game board with a plurality of squares designated as entrance squares and located on opposite sides of a central division into two kingdoms between opposed positions for two players. At the left of each player position a sanctuary is located and comprises an intermediate size planar element at a level above the game board, with a control square and a passage square, and a smaller size planar element at a level above the intermediate size element, with a control square, a passage square and a royal chair square. At the right of each player position a domain is located and comprises three planar elements, the first two like the intermediate and smaller size elements of the sanctuary and the smallest uppermost and having a throne designation on it. Each player advances, by turns in accordance with special rules and dice, tokens that are theme-related as: monarch, high advisor, warriors, squires and serfs, the goal being attainment of sovreignty.

A drawer-supplied carrying and supporting case includes a case half supporting the game board, and two case quarters that hinge to it and foldably support the domains and sanctuaries.

4 Claims, 10 Drawing Figures

130'
128
130a'
130b'
146b
124
144
148

148

48
122
146a
150
144'
128c'
128b'
142b'
128a'
126'
124'
126
142a'
142b
142a
128'
130
60
64
52'
62
30

132

134

136

138

140

MULTI-LEVEL BOARD GAME

FIELD OF THE INVENTION

This invention relates generally to games and particularly to board games.

SUMMARY OF THE INVENTION

The following U.S. Patents disclosed known game systems: U.S. Pat. No. DE. 200,109 issued to R. F. Hirsch on 1-19-65, disclosed a game board with black and white squares on a relatively large base and on four symmetrically arranged tri-level platforms at the corners of the base;

U.S. Pat. No. DE. 226,669 issued to C. M. Culver and D. A. Lane on 4-10-73, disclosed another three dimensional game board with marked squares on three base-supported, spaced platforms, the lowest of which at diagonal corners have two smaller platforms;

U.S. Pat. No. 1,877,154 issued to W. R. Weaver on 9-13-32, disclosed a two-level board with squares in a chess-like game;

U.S. Pat. No. 4,194,741 issued to D. M. Rea on 3-25-80, disclosed a square patterned game board with plural levels;

U.S. Pat. No. 4,438,027 issued to R. E. Kelly on 9-7-82, disclosed a multi-level board game with square-marked areas with chess-type playing pieces.

However, the prior art is believed not to provide the apparatus and inducement to logical thinking resulting according to objects of the present game system, nor to provide the excitements, conveniences and variations, all in an economical, attractive and durable embodiment usable at almost any location and easily carried and stored singly in bulk.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

GENERAL STRUCTURAL DETAILS

Figure 1:
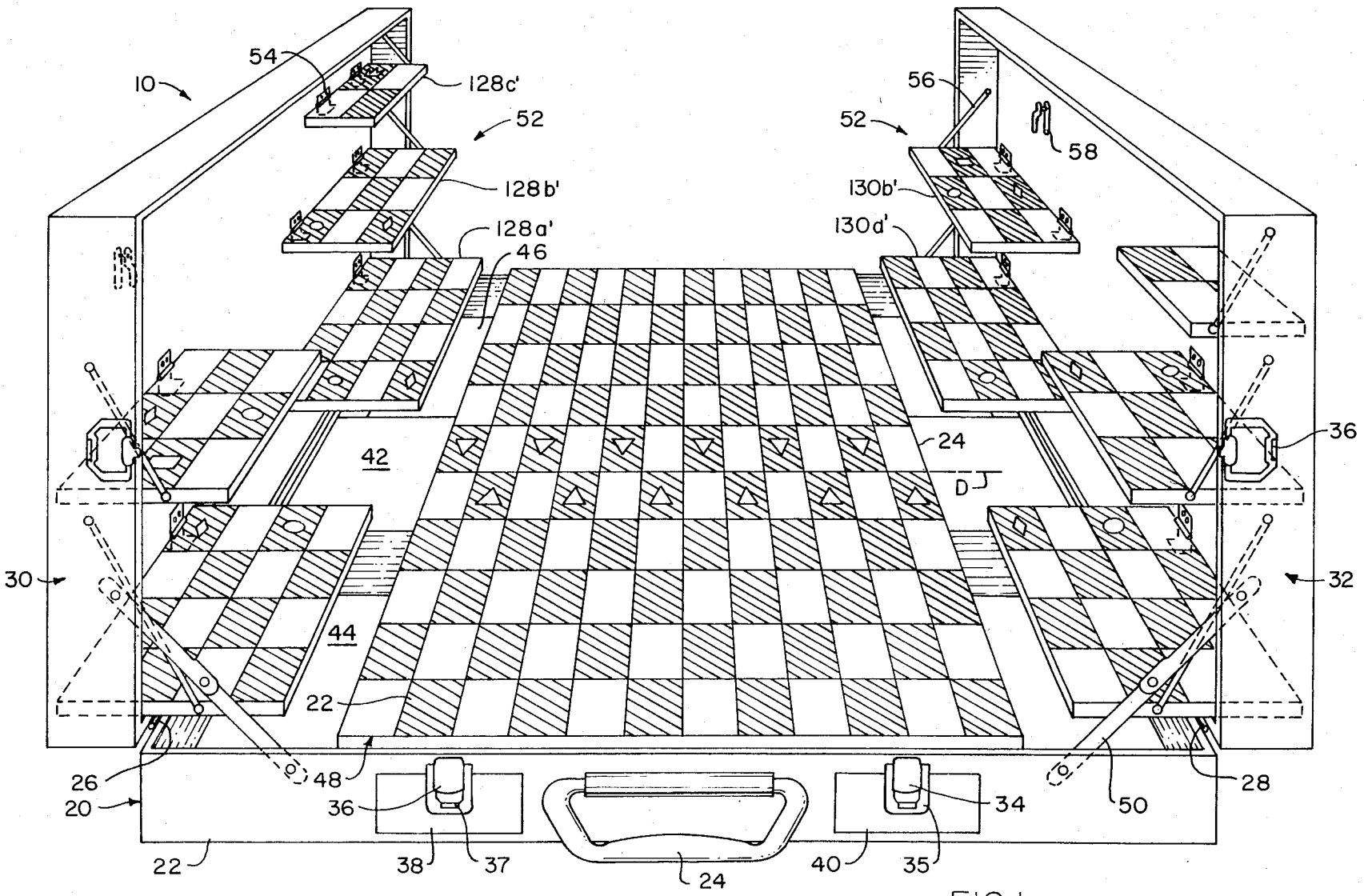
FIG. 1 is a top perspective view of the invention in the preferred embodiment.

FIG. 1 shows the invention in an embodiment 10. The game provides for two contesting players or "sids", disposed on opposite sides of the game board, the broken line D denoting the division between playing sides.

Supporting the board elements of the game is a special case 20 with, as a bottom, a case half 22 in the form of an upwardly open box with a carrying handle 24 at the center of one side. Hinges, 26, 28, shown, at opposite ends of the case respectively support each other open-top box-like portions or quarter cases 30, 32, which fold closed open-side down. Conventional matching latches 34, 36 on each side of the case half and case quarters keep the case closed. Supporting the lower portions of the latches may be drawers 38, 40 shown, that are held closed when the upper and lower latch portions are engaged to hold the case half and case quarters together for travel. The drawers may be used to carry the dice and tokens to be described, so that the game elements as a whole are kept together at all times. 35, 37 are drawer handles.

Along the dividing centerline D within the case half 22 is a supporting rib 42 that performs two functions: (1) to divide the case half into two storage spaces 44, 46 on the sides and (2) to support a game board portion 48. The game board portion 48 extends face-up from side-to-side along the center of the case half 22.

When th case half is laid on a table or the like in preparation for playing the game, conventional elbow braces 50 at each side hold the case quarters 30, 32 open at right angles to the case half 22.

An array 52 of planar elements, each hinged as at 54, is mounted inside each of the case quarters 30, 32. When the case quarters are held upright by the elbow braces, this array is held horizontal by any suitable means, such as a respective flexible line 56 secured to each end and to a case quarter, that will permit them to fold flat when the case quarters are closed, or alternatively, individually and tightly latched flat by catches 58 on the case quarter, before closing.

Thus, the invention includes a convenient, securely deployable and rattle-free folding support system for these game board elements and a carrying mode that both protects and holds them ready for instant use.

Figures 2, 3, 4, 5, 6, 7, 8, 9, 10:
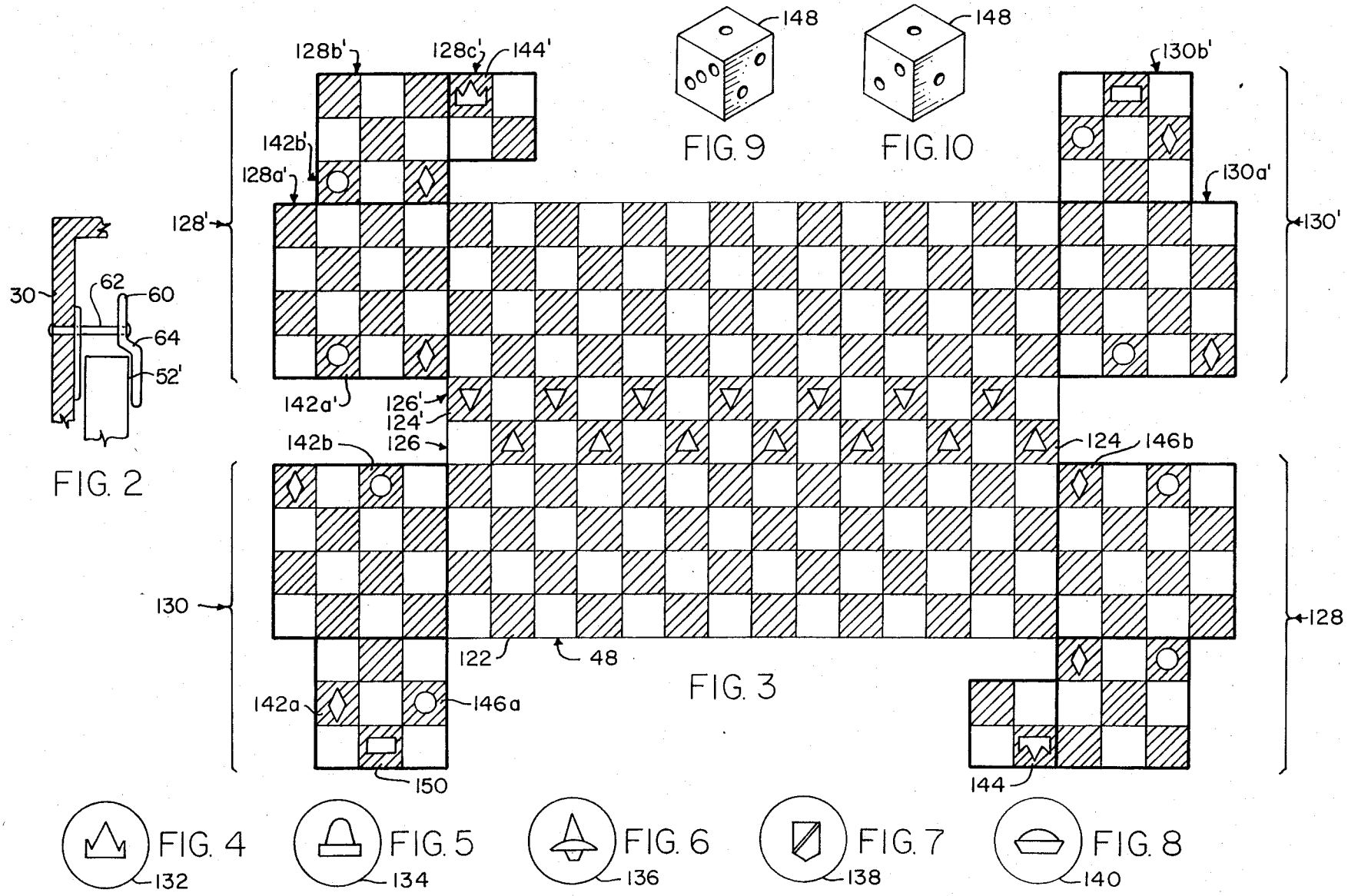
FIG. 2 is an elevational view of a latching detail.
FIG. 3 is a plan schematic view of game-board portions rearranged from FIG. 1 for exposition.
FIGS. 4–8 respectively depict in plan view variously identified playing tokens usable with the game board portions in playing the game of this invention.
FIG. 9 shows a die in a first position.
FIG. 10 shows the die in a second position.

FIG. 2 shows a catch detail, a typical edge 52' of an element of the array being held by a pivotal offset link 60 supported on a rivet 62 to a case quarter 30. It will be appreciated that this device holds the offset 64 at the edge of the element being held so that the rivet 62 must be slightly flexed to release the catch, preventing the catch from rattling free.

GAME OBJECTIVES IN BRIEF

FIG. 3 is referred to primarily at this point, with some references to FIG. 1 where noted.

The board 48 which is referred to as the STATE, is made up of sixty black playing squares 122 (alternating with red squares in checkerboard disposition) twelve of which are designated as ENTRANCE squares 124, 124' indicated by respective triangles.

The STATE 48 is divided into two kingdoms 126, 126', bordered by the two rows 124, 124' of ENTRANCE squares. Each of the kingdoms 126, 126' is an inverted replica of the other. Within each kingdom exists a tri-level structure named the DOMAIN, shown at 128, 128', and a bi-level structure entitled the SANCTUARY and shown at 130, 130'. The ENTRANCE squares 124, 124' bordering each of the kingdoms are used to enter a respective DOMAIN and SANCTUARY.

Each kingdom 126, 126' had in its realm a MONARCH, a HIGH ADVISOR, four WARRIORS, six SQUIRES, and six SERFS.

FIGS. 4–8 show examples respectively at 132, 134, 136, 138, 140. Each kingdom totals eighteen members.

OBJECT OF THE GAME

Returning to FIGS. 3 and 1, each side has two alternatives by which it may achieve SOVEREIGNTY and end the game.

One method is to capture the opposition's MONARCH. A second choice is by occupying a CONTROL square 142a, 142a' for example, indicated by a circle, on any level of the three levels 128a, 128b, 128c (FIG. 1) for example, in the opponent's DOMAIN 128, 128' (FIG. 3) and one from any level in the opponent's SANCTUARY 130, 130' while also occupying the opposition's THRONE 144, 144', the respective squares marked with crowns.

In either manner SOVEREIGNTY is established and the game is ended.

FURTHER DETAILS OF RULES AND STRUCTURES

THE DOMAIN

As noted, the DOMAIN is a tri-level structure 128, 128' situated to the player's right in each kingdom. Each level 128a', 128b', 128c', FIG. 1, also, for example is referred to as a chamber. The first or lowest chamber 128a' is called the CHAMBER of PRELIMINARIES. In this chamber a member begins its ascent towards the THRONE, 144 for example, whether to protect its own THRONE or in an attempt at capturing its opponent's THRONE.

The second chamber 128b' is named the CHAMBER of SECURITIES. At this level, a player must consider this chamber detrimental to the safety of its THRONE.

The third level 128c' for example, is entitled the ROYAL CHAMBER. Within this chamber sits the MONARCH'S THRONE.

All levels of the DOMAIN may be entered by the SQUIRES, WARRIORS, HIGH ADVISORS and MONARCHS of each kingdom. The SERFS are not allowed to leave the STATE at any time. They are limited to the sixty playing squares of the base of game board.

THE SANCTUARY

As noted, the SANCTUARY 130 is a bi-level structure (130a', 130b', FIG. 1 also, for example) situated to the left in each kingdom. All chambers of each SANCTUARY may only be entered by the WARRIORS, HIGH ADVISORS, and MONARCHS of each kingdom.

The first level 130a', for example, of the SANCTUARY is called the CHAMBER of LORDS. It derives its title from allowing only the LORDS of each KINGDOM (WARRIORS, HIGH ADVISORS and MONARCHS) to enter.

The upper level 130b', for example, of the SANCTUARY is referred to as the CHAMBER of REFUGE. It is here that the MONARCH and LORDS of each kingdom might seek an alternative means of shelter from its opponent. However, do not let its name deceive you; it may be an advantageous point of offense as well. on the first and second levels, there is one PASSAGE square 146a, 146b indicated by a diamond, as well as one CONTROL square 142a, 142b, indicated by a circle.

FIGS. 9 and 10 show the playing dice. Each side has one set of dice, colored to match the members of its kingdom.

Each die 148 has on its faces one three, two twos and three ones. For each turn, a player throws both dice at and same time outside the game board but in plain view of the opposing player.

Both dice must land in a flat position, not leaning against any other object, else both dice must be rolled again or until they have both clearly landed in a flat position. Each die indicates an advance for a respective member. That is, each number that appears on each die after a toss indicates the number of squares one member may take in a single move. Normally, a player may not move one member to the combined total of both dice, although exceptions will be explained below. In the event that a kingdom has only its MONARCH left to move, the player may use only one die. In the rare occasion of a kingdom unable to move any member, to the sum of a given die, then the turn is forfeited. If only one member is capable of moving to the sum of one die, then only one move is forfeited.

As noted, within the realm of each kingdom, there exists one MONARCH, one HIGH ADVISOR, four WARRIORS, six SQUIRES and six SERFS.

The MONARCH is able to move forward to the roll of one die. The MONARCH, however, is granted a few exceptions to this rule.

If a player rolls a pair of twos, the player may reserve the right to move its MONARCH from any square on the game board directly to the THRONE in the ROYAL CHAMBER of its own kingdom.

If a players rolls a pair of twos while its MONARCH occupies its own THRONE square, the MONARCH may reserve the right to travel from its own THRONE immediately to the ROYAL CHAIR 150, indicated by rectangle, in the CHAMBER of REFUGE in its own SANCTUARY, and vice-versa.

This privilege does not exist for the MONARCH to transpose itself from the opposition's THRONE to the opposition's ROYAL CHAIR, or vice-versa. The MONARCH of each kingdom has another option at its disposal. If a player rolls a pair of threes, the MONARCH has the right to interchange positions with its HIGH ADVISOR from anywhere on the game board.

In all these events, the player, after making one of the options mentioned above, relinquishes its right to move a second member of its KINGDOM on the same turn.

Once inside a DOMAIN or SANCTUARY of either KINGDOM, the MONARCH may move forward or backward but never touching the same square twice within the same move. This right of mobility is granted to all eligible members of both KINGDOMS once they enter the DOMAIN or SANCTUARY of either KINGDOM.

The MONARCH, however, is not able to capture an opposing member unless it is already occupying its own THRONE or the THRONE of its opposition. To capture another opposing member, the MONARCH must first return to a THRONE and await its next turn. The only exception to this rule is that each MONARCH may capture the opposing MONARCH at any time. It need not sit on either THRONE to initiate the capture of the opposition's MONARCH.

The HIGH ADVISOR is second only to the MONARCH. It, too, may exercise certain privileges. Beside the ability to transpose positions with the MONARCH, it has the option of moving forward or backward anywhere in the game board, but never using the same square twice. The HIGH ADVISOR is the only member of each KINGDOM to have this right. The HIGH ADVISOR also has the capability to capture any member of the opposition including its MONARCH.

The WARRIOR is the last member of either kingdom to share any privileges within the SANCTUARY. It is the final level of the kingdom that may enter the SANCTUARY of either kingdom. Each realm has but six members to its possession to use such a structure. Be certain you choose their moves wisely.

The WARRIOR, like the HIGH ADVISOR, may capture any member from the opposing side including the MONARCH.

The SQUIRE is the last member of either kingdom granted the right of entry to the DOMAIN. Do not take his position lightly, for the SQUIRE is capable of capturing all members of the opposing kingdom, including the opponent's MONARCH.

The SERF is the final member of each kingdom. It is the only member of either kingdom who is confined to the STATE (the base of the game board). It does have the capability to capture members of the opposite kingdom while they remain in the STATE. The SERF, however, may not capture another SERF. It does have the ability to capture the opposition's MONARCH while it resides in the STATE. Remember, though, the SERF may not enter the DOMAIN or SANTUARY of either kingdom at any time.

SETTING THE BOARD

Start with the back of the game board. In the last row, the black square, third from the left, is where the MONARCH is placed. The black square to the right of the MONARCH is the starting square for the HIGH ADVISOR. The two black squares to the left of the MONARCH and the two black squares to the right of the HIGH ADVISOR are where the four WARRIORS are placed. The next row of black squares in front is where the six SQUIRES sit, and the next row of black squares the six SERFS are placed.

The same positions are taken by the members of the opposite KINGDOM. Each player takes his or her corresponding dice and the game is about to begin.

PLAYING THE GAME

Each KINGDOM has a pair of corresponding dice. Both players roll both dice and the highest roll wins the honor of going first. If there is a tie, both players continue rolling until a winner is determined.

The winner must now roll both dice to determine the number of moves he or she may take. Each die entitles the player to move one member forward (except when an eligible member is in the DOMAIN or SANCTUARY of either kingdom) to the number displayed on each die. A player may not move a member of its kingdom to the combined sum of both dice. (See the section on "The Members of the Kingdom" for the exception to this rule.)

Once both members have been moved, the turn is over and it is now the opposition's. (Each move is terminated when a player removes his or her hand from a member of its kingdom once its position has been changed.)

While a member is still within the STATE, it may only move forward, except for the HIGH ADVISOR of either kingdom.

A member may not jump another member of its own kingdom or that of the opposite side, in the attempt to reach an unoccupied square. A square must be opened for a member to occupy it or the member may proceed to a square already taken by the opposition on the exact roll of a die, thereby initiating a capture. An attacking member must be at least two squares and no more than three squares away to be eligible to capture a member of the opposing kingdom. A member, resting on a square that is next to its opponent, may not initiate a capture. Such a situation is called a TRUCE. Neither party may attack or capture the other until one or the other member retreats. The only exception to this rule is when a member is on an ENTRANCE square of a given kingdom or a PASSAGE square in a given structure and rolls at one and proceeds to the proper FOYER square (the farthest square to the right and rear of each level in each structure) of a given level in the proper kingdom's structures. If the FOYER square is already occupied by a member of the opposition then a capture is permitted. A member may not capture the opposition from the FOYER square to the ENTRANCE square. However, a capture is allowed from the FOYER square to the PASSAGE square.

It should be noted that in the CHAMBER of REFUGE in each SANCTUARY, and in the ROYAL CHAMBER in each DOMAIN, the FOYER square is the only undesignated black square within each of those chambers.

If a member chooses not to enter a kingdom's structure and passes the ENTRANCE squares of both kingdoms, then the member has no other option than to venture to the BORDER of the STATE(the farthest playing squares in the opposition's kingdom.) Once reaching such a square safely, the player has completed a MISSION of VALOR, or rescue. Each MISSION of VALOR rescues but one member only. If the rescuer remains at the BORDER of the STATE until the MONARCH's starting square is vacant, it does not repeatedly free newly captured members.

If there are no members to be saved, then the rescuer must remain at the BORDER of the STATE until a member of its kingdom is captured, and then that member, and only that member, may be returned to its MONARCH's original starting square once it is vacated.

In the event that two or more members of a kingdom complete a MISSION of VAlOR, and resides at the BORDER of the STATE at the same time, then a rescuer must return to its MONARCH's starting square (once it is vacated) by the sequence of its arrival at the BORDER of the STATE. Once a rescue has been made, the RESCUER must return to the MONARCH's starting position on the very next turn, if it is vacated. If not vacated it must use one roll of the die on the following turn once it has been vacated.

These rules apply to all members of both kingdoms including the HIGH ADVISORS.

This entitles that player to replace a captured member of his or her choosing to the original starting square of its MONARCH, when unoccupied. The returned member may not be moved until the following turn, even if only one roll of one die has been used.

The rescuing member may not return until the MONARCH's original starting square has been vacated, and then it may only proceed again forward on a following turn. A roll of one on either die is required before the rescuer may return to the MONARCH's starting square one vacated.

ENTERING THE DOMAIN

A member may enter its own DOMAIN or that of its opponent's by landing on the proper kingdom's ENTRANCE square (designated by a triangle). A member must land on this square by the exact roll of a die. The member must now wait until a following turn before it may enter a given structure. (A member is ineligible for capture while on this spot. It is a square of neutrality).

On a following turn, the member may enter the structure at the first level and only through the FOYER square.

Each of the first two levels of the DOMAIN(and the two levels of the SANCTUARY) have a PASSAGE square (indicated by a triangle).

The use of the PASSAGE square is three-fold. First, a member must land here by the exact roll of a die and then on a following turn it may proceed to the next level of that structure.

Secondly, the PASSAGE square may be used to transport a member to the FOYER square of the same level in the opposition's DOMAIN on a following turn, even it if is already occupied by the opposing kingdom, thus initiating a capture. (This right of transport is allowed only when entering from one DOMAIN to the other DOMAIN and when transporting a member from one SANCTUARY to the other SANCTUARY.)

Thirdly, the PASSAGE square is the only position by which a member may capture an opposing member who occupies a CONTROL square within the same level. A member must first venture safely to the PASSAGE square and then on a following turn, a roll of two is needed to capture both the opposition and the CONTROL square.

The CONTROL square (indicated by a circle) is used to help achieve SOVEREIGNTY. The CONTROL square represents the strategic points within each structure and once one from any level of the opposition's DOMAIN and one from any level of the opponent's SANCTUARY has been captured along with capturing the opposing side's THRONE, then supreme control has been established or more appropriately, SOVEREIGNY is achieved.

THE SANCTUARY

The same rules of entry, exist, attack, capture, and mobility apply to all eligible member once inside the SANCTUARY.

FOOTNOTE

The CONTROL squares of both kingdoms also must be landed upon by the exact throw of a die before a member is enabled to progress to the first level in a kingdom's structure.

The same procedure is taken when using a PASSAGE square for transport to a higher level in the same structure or when using a PASSAGE square to transport a member to a FOYER square of the same level and same structure in the opposition's kingdom, and vice-versa.

However, it must be noted that a member does not need an exact toss of the die to leave the FOYER square of a level to the PASSAGE square of a lower level or to leave the FOYER square in the first chamber of either structure in a given kingdom to return to the STATE (the base of the game board).

If a member does choose to return to the STATE, the member must do so by leaving through the FOYER square in the first chamber of the structure that it resides and returning to the farthest ENTRANCE square to the left in the proper kingdom, and containing forward to the remaining sum of the die used. In the event that the farthest ENTRANCE square is occupied, the ENTRANCE square to the right of that may be used for exit, and so on. (This means the farthest ENTRANCE square to your left in your kingdom and the farthest ENTRANCE square to your right in your opponent's kingdom is used.)

Logically, if all ENTRANCE squares are already preoccupied, than an exit is impossible.

In conclusion, the basic concepts of this game provide a unique and innovating challenge. The logistics of attack and defense are limited only by each individual's strategic capabilities. The outcome will be determined by both players' diverse endeavors for the ultimate goal: SOVEREIGNTY'

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of board game with a plurality of planar elements having respective rectangular arrays of playing squares, means for holding the planar elements, token, and chance apparatus, the improvement comprising: first and second opposed kingdoms including a game board having a plurality of entrance squares located on opposite sides of a central part of the game board; to the left of each kingdom a sanctuary including: an intermediate size planar element at a level above the game board and a smaller planar element at a level above the intermediate size planar element; to the right of each kingdom a domain including three planar elements, the first two planar elements thereof being situated similarly to the intermediate size and smaller size planar elements of the sanctuary and the third planar element thereof being smallest and uppermost; the means for holding including a case half, a pair of case quarters, hinge means for holding the case quarters upright in open position on the case half and for permitting the case quarters to close for covering the case half, and means for pivotally supporting each said planar element in position for playing said board game when the case quarters are in open position and for causing each planar element to fold as the case quarters close.

2. In a system as recited in claim 1, each said kingdom having a plurality of entry squares along said center part, the planar elements of each of said sanctuary having respectively a control square and a passage square, said first two planar elements of each domain having each a control square and a passage square, and each of said third planar elements having a royal chair square.

3. In a system as recited in claim 2, said tokens including monarch tokens, high advisor tokens, warrior tokens, squire tokens, and serf tokens.

4. In a system as recited in claim 1, said case half having a pair of storage drawers in an end portion thereof and an open top portion with a plurality of storage spaces therein.

* * * * *